United States Patent [19]

Brown

[11] Patent Number: 4,595,248

[45] Date of Patent: Jun. 17, 1986

[54] TERMINAL BLOCK

[76] Inventor: James C. Brown, 9923 Neil Armstrong Ct., Fort Wayne, Ind. 46804

[21] Appl. No.: 487,448

[22] Filed: Apr. 21, 1983

[51] Int. Cl.[4] ..... H01R 9/09; H01R 9/18; H01R 9/24

[52] U.S. Cl. ..... 339/17 LC; 339/198 R; 339/198 P

[58] Field of Search ..... 339/198 R, 198 E, 198 G, 339/198 GA, 198 H, 198 P, 17 R, 17 LC, 198 S

[56] References Cited

U.S. PATENT DOCUMENTS

| | | | |
|---|---|---|---|
| 2,439,744 | 4/1948 | Mentor | 339/198 P |
| 2,766,436 | 10/1956 | Luebking | 339/198 R |
| 2,991,440 | 7/1961 | Kulka | 339/17 R |
| 3,215,975 | 11/1965 | Kinkaid | 339/17 LC X |
| 3,426,315 | 2/1969 | DeTar | 339/184 M X |
| 3,582,867 | 6/1971 | Thompson et al. | 339/184 M X |
| 3,601,746 | 8/1971 | Teagno | 339/17 R X |
| 3,636,502 | 1/1972 | Wallace | 339/198 R |
| 3,980,383 | 9/1976 | Dickey et al. | 339/198 R |
| 4,239,324 | 12/1980 | Stenz | 339/198 H X |
| 4,385,791 | 5/1983 | Lovrenich | 339/198 R X |

FOREIGN PATENT DOCUMENTS

| | | | |
|---|---|---|---|
| 129386 | 10/1979 | Japan | 339/198 R |
| 175898 | 7/1961 | Sweden | 339/198 R |
| 462914 | 11/1968 | Switzerland | 339/198 R |

*Primary Examiner*—Gil Weidenfeld
*Assistant Examiner*—Steven C. Bishop
*Attorney, Agent, or Firm*—David A. Lundy

[57] ABSTRACT

A terminal block, to be used to connect a first series of electrical conductors to a second series of electrical conductors which comprises a base block, a cap block disposed on said base block, the cap block is removably connected to the base block. A plurality of cap contacts are disposed in the cap block. The cap contacts are electrically isolated from each other. A plurality of base contacts are disposed in the base block. The base contacts are electrically isolated from each other. The base contacts retain and are in electrical contact with the cap contacts on a one to one basis.

9 Claims, 5 Drawing Figures

TERMINAL BLOCK

BACKGROUND OF THE INVENTION

The present invention pertains to terminal blocks and more particularly to a two-piece terminal block which can be readily dismantled and reassembled after it is installed without removing any of the conductors attached to the terminal block.

Terminal blocks have been used for many years to connect groups of wires or other conductors together. Terminal blocks of a number of types have been developed including some for use with printed circuit boards such as U.S. Pat. No. 2,991,440. Terminal blocks may be one piece as in U.S. Pat. No. 2,991,440 or multi-piece as in U.S. Pat. No. 3,636,502. Single piece terminal blocks have the problem that once a series of wires has been connected the wires cannot be removed as a group but must be removed one wire at a time. Multi-piece terminal blocks solve that problem, however, multi-piece terminal blocks face the problem that electrical contacts must be maintained between the pieces of the terminal block. In prior art multi-piece terminal blocks, mechanical stresses could adversely affect electrical connections and could reduce the lifetimes of terminal blocks to less than the lifetimes of their attached circuit boards.

It is therefore highly desirable to provide an improved terminal block and that is not affected by mechanical stresses and impacts and will last the lifetime of a circuit board.

It is also highly desirable to provide an improved terminal block that is composed of two pieces which can quickly and easily be dismantled and reassembled without removing attached conductors.

It is further highly desirable to provide an improved terminal block which can be repaired and replaced easier than heretofore possible.

It is likewise highly desirable to provide an improved terminal block that permits rapid and easy replacements or changes of circuit boards in an apparatus.

It is yet also highly desirable to provide an improved terminal block that is composed of two pieces and provides large areas of positive contact between contacts in the two pieces.

It is yet further highly desirable to provide an improved terminal block that is composed of two pieces the tight connection of which is not critical to the operation of the terminal block.

It would finally be highly desirable to provide an improved terminal block which meets all of the above desired features.

SUMMARY OF THE INVENTION

It is an object of this invention to provide an improved terminal block.

It is another object of the invention to provide an improved terminal block and that is not affected by mechanical stresses and impacts and will last the lifetime of a circuit board.

It is also highly desirable to provide an improved terminal block that is composed of two pieces which can quickly and easily be dismantled and reassembled without removing attached conductors.

It is another object of the invention to provide an improved terminal block which can be replaced and repaired easier than heretofore possible.

It is yet another object of the invention to provide an improved terminal block that permits rapid and easy replacements or changes of circuit boards in apparatus.

It is still a further object of the invention to provide an improved terminal block that is composed of two pieces and provides large areas of positive contact between contacts in the two pieces.

It is yet also another object of the invention to provide an improved terminal block that is composed of two pieces the tight connection of which is not critical to the operation of the terminal block.

It is still another object of the invention to provide an improved terminal block which meets all of the above desired features.

In the broader aspects of the invention there is provided a terminal block, to be used to connect a first series of electrical conductors to a second series of electrical conductors which comprises a base block, a cap block disposed on said base block. The cap block is removably connected to the base block. A plurality of cap contacts are disposed in the cap block. The cap contacts are electrically isolated from each other. A plurality of base contacts are disposed in the base block. The base contacts are electricaly isolated from each other. The base contacts retain and are in electrical contact with the cap contacts in a one to one basis.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
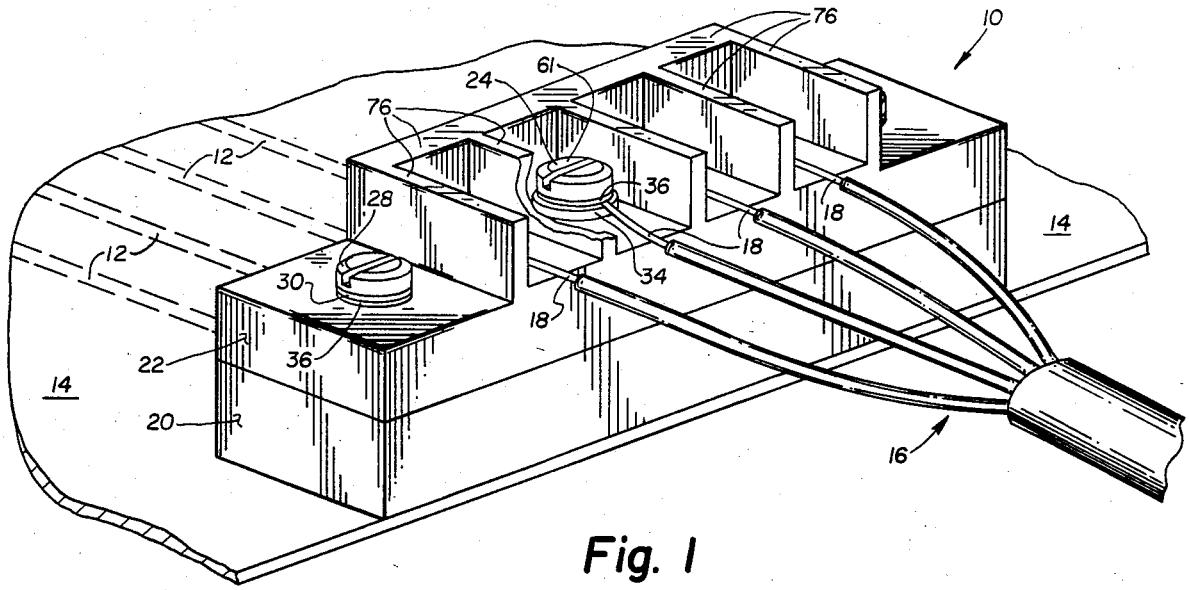
FIG. 1 is a fragmentary perspective view of the improved terminal block of the invention installed on a printed circuit board and connected to a first series of conductors imprinted on that board and also connected to a second series of conductors.
Figure 2:
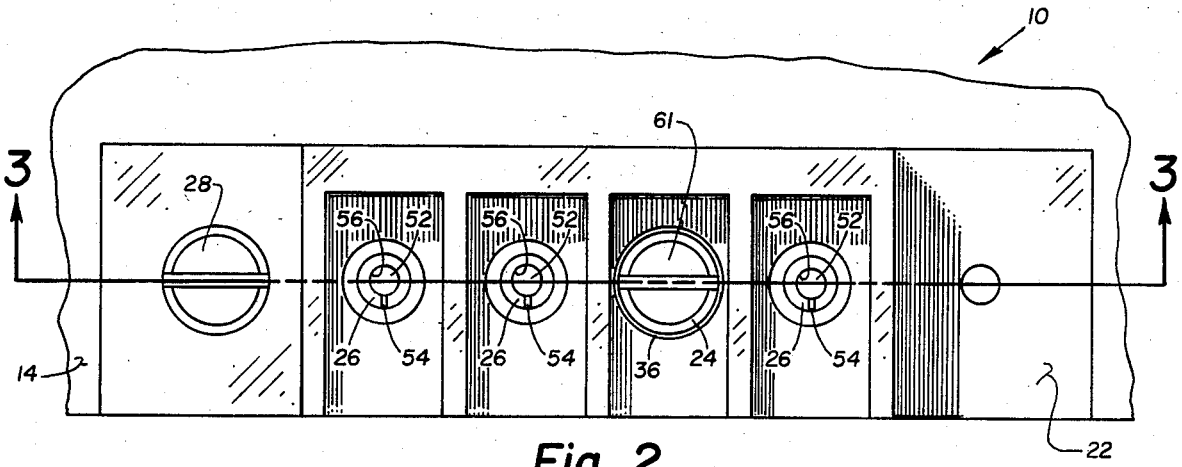
FIG. 2 is a fragmentary top plan view of the terminal block and circuit board shown in FIG. 1 with three of the cap contacts and one of the captive screws removed.
Figure 3:
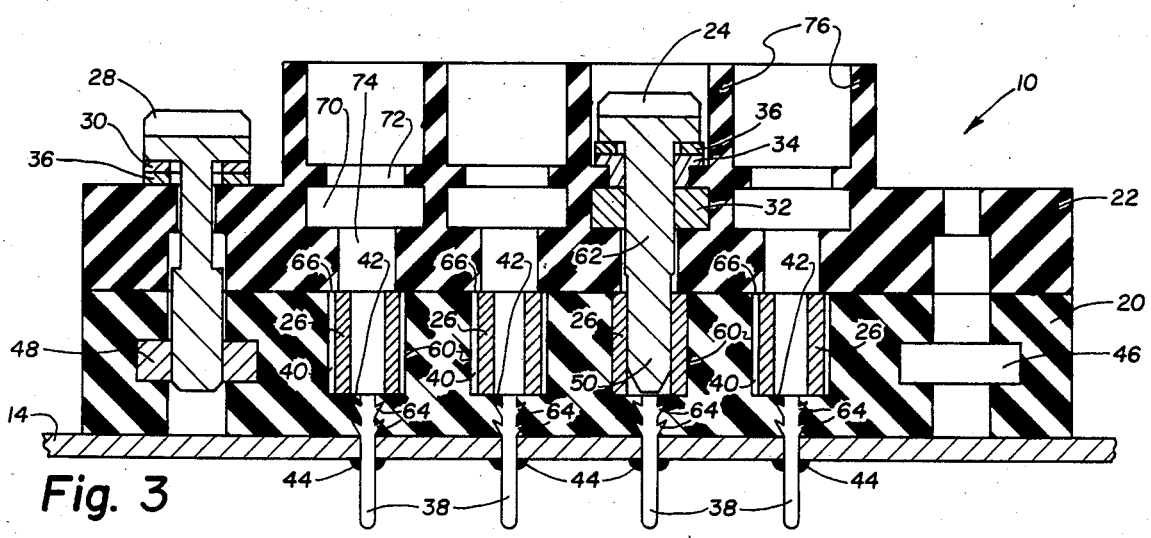
FIG. 3 is a fragmentary cross-sectional view of the side of the terminal block substantially along the section line 3—3 of FIG. 2.
Figure 4:
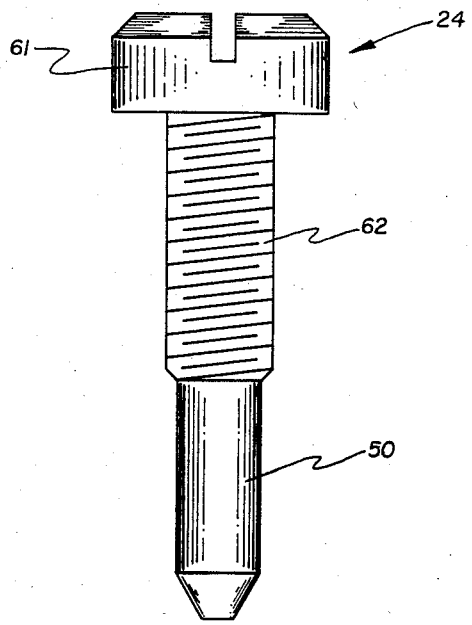
FIG. 4 is a plan view of one of the cap contacts.
Figure 5:
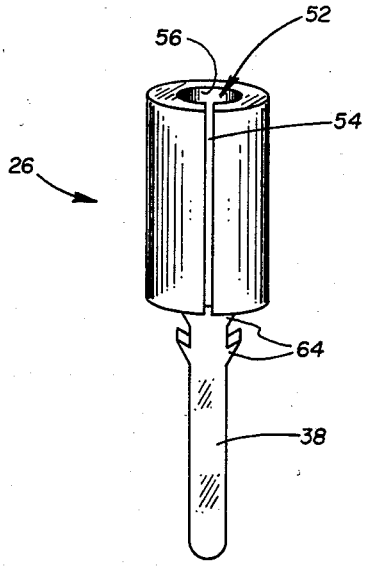
FIG. 5 is a perspective view of one of the base contacts with its attached tail.

The terminal block 10 of the invention is designed to be used to connect a first series of conductors 12 imprinted on a printed circuit board 14 to a second series of conductors 16. The second series of conductors 16 may end as bare wires 18 or as electrical connectors.

The terminal block of the invention 10 is composed of a base block 20 and a cap block 22 both made of insulating material, a plurality of cap contacts 24 are disposed in the cap block 22 and are retained by and in electrical contact with a plurality of base contacts 26 disposed in chambers 40 in the base block 20. The chambers 40 have lateral surfaces 60, bottom surfaces 42 and apertures 66.

The cap contacts 24 have heads 61 and threaded portion 62 reciprocally threaded to nuts 32 disposed within the cap block 22. The nuts 32 are retained within cavities 70 within the cap block 22. Bushings 34 rest upon nuts 32 and are partially disposed within cavities 72 in the cap block 22. Flat washers 36 rest on the bushings 34. Cap contacts 24 are disposed within the cap block 22 with the threaded portions 62 within the bushings 34, the nuts 32 and cavities 74. Wires 18 of the second series of conductors 16 are retained by the terminal block 10 of the invention by placement between the flat washers 36 and the bushings 34 which are forced against each other by the action of tightening the cap contacts 24 into the nuts 32. The heads 61 of the cap contacts 24 and their associated flat washers 36 and bushings 34 are surrounded on three sides by partitions 76 which protect the cap contacts 24 and prevent the wires 18 from short circuiting. The partitions 76 are of insulating material and may be formed as a part of the cap block 22.

The terminal block 10 of the invention is connected to the printed circuit board 14. A plurality of tails 38 are attached to the base contacts 26. The base contacts 26 and tails 38 are made of resilient conducting material, such as beryllium copper. The base contacts 26 and tails 38 may be formed in one piece by rolling sheet metal cut to shape. The tails 38 have the same curvature as the base contacts 26. The tails have barbed portions 64 which are resiliently flexible and retain the base contacts 26 within the chambers 40 and the base block 20. In a particular embodiment the barbed portion 64 of the tails 38 may be cast in place within the base block 20 when the base block 20 is formed. Electrical connections are made between the base contacts 26 and the first series of electrical conductors 12 by means of the tails 38. The tails 38 are soldered to the printed circuit board 14. Solder connections 44 thus formed place the first series of conductors 12 and the base contacts 26 in electrical contact and mechanically retain the terminal block 10 of the invention on the printed circuit board 14.

The cap block 22 and the base block 20 are detachably connected together by spring washers 30 and captive screws 28. Captive screws 28 are disposed within cavities 46 in the base block 20 and the cap block 22. Captive screws 28 are reciprocally threaded to nuts 48 which are immovably retained by the base block 20. Tightening the captive screws 28 into the nuts 48 draws the base block 20 against the cap block 22. This action is mediated by the spring washers 30 which help prevent over-tightening of the captive screws 28 and help maintain tension on the captive screws 28 despite changes in temperature or mechanical stresses.

At the time the cap block 22 and the base block 20 are assembled, the cap block 22 is placed on the base block 20 and the ends 50 of the cap contacts 24 are inserted into the hollow cores 52 of the base contacts 26 where the ends 50 of the cap contacts 24 press against the inner surfaces 56 of the base contacts 26. The base contacts 26 are expandible since they are discontinuous due to gap 54. This permits the ends 50 to be inserted since they are larger in diameter than the hollow cores 52. The base contacts 26 are made of resilient conducting material, such as beryllium copper, and grip the ends 50 when they have been inserted. This provides a large area of electrical contact between ends 50 and the inner surface 56 of the base contacts 26. This large area of positive electrical contact results in a low current density through any one portion of either the base contacts 26 or the cap contacts 24, thereby reducing the chance of arcing and lessening the danger of burning and corroding the contacts 24 and 26.

The area of contact of the base contacts 26 and the cap contacts 24 has its longest dimension in the direction of travel of the cap contacts 24 when they are tightened against the nuts 32 thus decreases of the area of contact between the base contacts 26 and cap contacts 24 is relatively slight due to the displacement of the cap contacts 24 as a result of thick wires 18 or the cap block 22 and the base block 20 being not firmly connected together due to looseness of the captive screws 28. The area of electrical contact between the base contacts 26 and the cap contacts 24 would be reduced but a relatively large portion of the cap contacts 24 and the base contacts 26 would still be in positive electrical contact.

There are no loose parts on either the cap block or the base block. Thus, the cap block and the base block may be each stored separately prior to assembly. If desired, the base block 20 may be connected to the first series of conductors 12 and the printed circuit board 14 and the cap block may be connected to the second series of conductors 16 prior to the time that the cap block 22 and the base block 20 are assembled and both the cap block and the base block can be replaced if necessary easier than heretofore possible with prior terminal blocks.

The invention disclosed provides an improved terminal block which is not affected by temperature changes and mechanical stresses, and which can be repaired and replaced easier than heretofore possible; and yet has all of the advantages of prior terminal blocks.

While a specific embodiment of the invention has been shown and described herein for purposes of illustration, it is desired that the protection afforded by any patent which may issue upon this application not be limited strictly to the disclosed embodiment; but that it extend to all structures and arrangements which contain the essence of the invention and which fall fairly within the scope of the claims which are attended hereto:

What is claimed is:

1. A terminal block for connecting a printed circuit board containing a first series of electrical conductors to a second series of electrical conductors, said terminal block comprising: a base block, a cap block disposed on said base block, a plurality of cap contacts removably secured to said cap block, said cap contacts being electrically and mechanically isolated from each other, a plurality of base contacts secured to said base block, said base contacts being electrically and mechanically isolated from each other, said base contacts being in electrical contact with said cap contacts on a one-to-one basis when said cap block is disposed on said base block, means is addition to said contacts extending between said cap and base blocks for preventing said cap and base blocks from unintentionally separating, said cap and base contacts being mechanically and electrically isolated from said preventing means, means for electrically connecting said base contacts to said printed circuit board conductors on a one-to-one basis, means for removably electrically connecting said cap contacts to said second series of electrical conductors on a one-to-one basis, whereby said terminal block provides an interface between said printed circuit board and said second series conductors with said cap and base blocks being accessible to maintain, repair, and replace independently of each other.

2. The terminal block of claim 1 wherein said base contacts have the shape of discontinuous sleeves and said base contacts are resiliently expandible to permit interpositioning of said cap contacts on a one to one basis when said cap block and said base block are connected.

3. The terminal block of claim 1 wherein said means for electrically connecting said printed circuit board conductors to said base contacts comprises a plurality of tails, said tails being of conducting material, said tails being in electrical contact with said base contacts on a one to one basis, said tails protruding from said base block to permit connection of said printed circuit board conductors to said tails on a one to one basis.

4. The terminal block of claim 1 wherein said means for electrically connecting said printed circuit board conductors to said base contacts comprises a plurality of tails, said tails bcing of conducting material, said tails being attached to said base contacts on a one to one basis, said tails protruding from said base block to permit connection of said printed circuit board conductors to said tails on a one to one basis, said tails being secured within said base block to retain said base contacts within said base block.

5. The terminal block claim 1 wherein said means for electrically connecting said second series of conductors to said cap contacts comprises said cap contacts being threadedly received in said cap block whereby said second series of conductors may be retained against said cap contacts when said cap contacts are tightened and each of said cap contacts can be removed from said terminal block without separating said cap and base blocks.

6. The terminal block of claim 1 wherein said base contacts are female electrical contacts and said cap contacts are male electrical contacts.

7. The terminal block of claim 6 wherein said female electrical contacts have an axial length and said male electrical contacts extend from said cap block a length generally equal to the axial length of said female contacts.

8. The terminal block of claim 1 wherein said preventing means includes a headed fastener extending through said cap block and into said base block, said fastener being threadedly received by said base block, said cap block being between said head of said fastener and said base block whereby said cap block and base block may be separated without removing said cap block contacts from said cap block.

9. The terminal block of claim 1 wherein said base block has a plurality of chambers, each of said chambers having a lateral surface and a bottom surface and an aperture, said plurality of base contacts being disposed within said chambers on a one-to-one basis, said base contacts each having an inner surface and an outer surface and a hollow core, said inner surfaces being generally contiguous with said cap contacts and said outer surfaces being gripped by said lateral surfaces when said cap contacts are within said hollow cores, said base contacts extending through said apertures and beyond said base block, said cap contacts being frictionally held within said base contacts when said cap block is disposed on said base block whereby said cap block and base block are held together by said contacts.

* * * * *